US008474190B1

(12) United States Patent
Sanderson

(10) Patent No.: US 8,474,190 B1
(45) Date of Patent: Jul. 2, 2013

(54) PORTABLE MODULAR SEATING ASSEMBLY

(76) Inventor: Derek J. Sanderson, Northridge, CA (US)

( * ) Notice: Subject to any disclaimer, the term of this patent is extended or adjusted under 35 U.S.C. 154(b) by 127 days.

(21) Appl. No.: 13/136,044

(22) Filed: Jul. 21, 2011

(51) Int. Cl.
*E04H 3/12* (2006.01)

(52) U.S. Cl.
USPC ..... 52/8; 52/182

(58) Field of Classification Search
USPC ..... 52/9, 8, 6, 183, 182
See application file for complete search history.

(56) References Cited

U.S. PATENT DOCUMENTS

| | | | | |
|---|---|---|---|---|
| 2,343,832 | A | 3/1944 | Pinson et al. | |
| 3,117,350 | A * | 1/1964 | Margadant | 52/8 |
| 3,230,907 | A | 1/1966 | Morford et al. | |
| 3,451,361 | A | 6/1969 | Sorenson | |
| 3,525,184 | A | 8/1970 | Harbers et al. | |
| 3,914,909 | A | 10/1975 | McNeal | |
| 4,611,439 | A | 9/1986 | Graham et al. | |
| 4,638,604 | A * | 1/1987 | Rogers et al. | 52/6 |
| 4,790,594 | A | 12/1988 | Temos | |
| 4,979,340 | A * | 12/1990 | Wilson et al. | 52/9 |
| 5,292,177 | A | 3/1994 | Balderi | |
| 5,605,025 | A * | 2/1997 | Paddock | 52/741.3 |
| D441,461 | S | 5/2001 | Bryjak et al. | |
| 7,739,838 | B2 | 6/2010 | Borglum et al. | |
| 8,347,556 | B2 * | 1/2013 | Stelmaszek et al. | 52/9 |
| 2011/0219705 | A1 * | 9/2011 | Uhl | 52/9 |
| 2012/0102845 | A1 * | 5/2012 | Van Stokkum | 52/9 |

* cited by examiner

*Primary Examiner* — Christine T Cajilig
(74) *Attorney, Agent, or Firm* — Albert O. Cota

(57) ABSTRACT

A portable modular seating assembly (PMSA 10) that is designed to be temporarily or permanently located on a sport field such as a soccer field. The PMSA (10) is comprised of a left structure (12), a right structure (34), a front structure (60), an inner reinforced panel 80 and a central support structure (96). The front structure (60) is attached to the front edges of the left structure (12) and the right structure (34). Between the two structures (12,34) is attached a set of stairs (82). The stairs are bordered by a passage (87) that is attached between the two sets of stairs (82). The PMSA (10) can also be designed to incorporate an indicia viewing structure (110) that can include a removably attached tarp (134) that is attached during periods of inclement weather or bright sunlight.

20 Claims, 13 Drawing Sheets

PORTABLE MODULAR SEATING ASSEMBLY

TECHNICAL FIELD

The invention generally pertains to portable seating assemblies, and more particularly to a portable modular seating assembly that can be quickly and easily set up at a sporting event such as a soccer match.

BACKGROUND ART

For thousands of years, sporting events and competitions have been one of the most popular forms of entertainment. Today, throughout the world sporting events are the predominant means of both entertainment and recreation for people of both sexes and all ages. Due to the number of, and variety of, individual sports, it is difficult to classify them. Two ways of differentiating sports is to separate those that are played indoors or outdoors, and those that are played by individual people or teams, although there are some sports that can be played both indoors and outdoors by individuals and teams.

The number of people who participate in sports has grown in both recreational/amateur groups and professional groups. Additionally, the number of people who enjoy watching sports has also grown significantly. The introduction of televised sporting, events has made it convenient and easy for many people to watch their favorite sporting event(s). While televised sporting events do provide a popular viewing means, especially for sporting events that are not occurring at a close location, most sport fans agree that the optimal viewing experience can only be achieved by being present at the event. It is a shared experience among the fans of a particular athlete or team, an experience that unites many different people in a common goal.

Unfortunately, it is not also possible to provide fans with the ability to easily view a sporting event. Of course, professional sporting events often occur in large, purpose-built indoor or outdoor stadiums or arenas, which are capable of seating thousands of individuals. This is not the case though for lower-level, non-professional and professional sporting events, even when these events are highly organized and attract a significant number of fans.

Perhaps the most serious example of this problem occurs during games of non-professional soccer. Throughout the United States there are many amateur soccer leagues which are played by both adults and children. There are organized teams and scheduled matches between the various teams in a league and many parks provide soccer fields that are reserved for each match. The problem is that there is usually little or no seating available at a park for spectators/fans. The people watching the soccer match either bring their own folding chair(s), place a blanket on the ground, or simply stand in place around the field.

Obviously what is needed is a convenient and easy method of providing seating at a sporting event where other seating is not available. The seating must be simple and quick to assemble and disassemble and must be capable of providing seating for various numbers of individuals and/or at locations, such as fields, of various sizes. Optimally, it would be beneficial to provide seating that is similar to typical stadium type seating which has proven to be effective for sporting events.

A search of the prior art did not disclose literature or patents that read directly on the claims of the instant invention. However, the following U.S. patents are considered related.

| Pat. No. | INVENTOR | ISSUED |
|---|---|---|
| 7,739,838 | Borglum, et al | 22 Jun. 2010 |
| 5,292,177 | Balderi | 8 Mar. 1994 |
| 4,611,439 | Graham, et al | 16 Sep. 1986 |
| 3,914,909 | McNeal | 2.8 Oct. 1975 |
| 3,451,361 | Sorenson | 24 Jun. 1969 |

The U.S. Pat. No. 7,739,838 discloses an easily and quickly assemble a bleacher that includes light-weight components which can be assembled by one person without the use of tools. The bleacher includes a latching and locking mechanism for attaching a seat boards, foot boards and riser boards without the use of fasteners.

The U.S. Pat. No. 5,292,177 discloses a modular seating system having at least two supporting elements that function as a seat support. Each supporting element includes a hollow shape having vertical supporting walls and is formed from a polymer reinforced by an inert fibrous filler. The elements support a seating component that includes a beam provided with a first plate affixed at each end in a plane perpendicular to the axis of the beam. One or more seating units are attached to and supported by the beam.

The U.S. Pat. No. 4,611,439 discloses a portable bleacher including a mobile frame supporting a pair of hinged elongated stringer members, each carrying a plurality of seats. When the stringer members are pivotally swung to their operative position the stringer members are aligned and decline transversely of the mobile frame. The bleacher may also be provided with extensible and collapsible rails which move with the stringer members.

The U.S. Pat. No. 3,914,909 discloses a bleacher construction which has a plurality of hinged sections. The sections interfit when pivotally folded together to define a readily portable assembly.

The U.S. Pat. No. 3,451,361 discloses a portable bleacher structure comprising a frame having rearward and forward ends and a floor engaging portion. The frame has a plurality of casters secured to its rearward end so that the bleacher can be tipped rearward 90-degrees from its normal position to a transport position. A plurality of stop assists are secured to the rearward end of the frame which engage the floor during the transport operation.

For background purposes and as indicative of the art to which the invention relates, reference may be made to the following remaining patents found in the search:

| Pat. No. | INVENTOR | ISSUED |
|---|---|---|
| D441,461 | Bryjak, et al | 1 May 2001 |
| 2,343,832 | Pinson, et al | 7 Mar. 1944 |
| 3,230,907 | Morford, et al | 25 Jan. 1966 |
| 3,525,184 | liarbers, et al | 25 Aug. 1970 |
| 4,790,594 | Temos | 13 Dec. 1988 |

DISCLOSURE OF THE INVENTION

The portable modular seating assembly (PMSA), also referred to as STUD STAND ONE™, provides a comfortable and safe seating structure that can be easily and quickly assembled on a sport playing field such as a soccer field or at other group oriented events. In its basic design configuration the PMSA is comprised of:

A) A left structure and a right structure each having a front edge and a rear edge, B) A front structure having a front surface and a rear surface, C) An inner reinforced panel having a front surface attached to the rear surface of the front structure, a rear surface, a first upper surface and a second upper surface, D) A central support structure having a front surface attached to the rear surface on the inner reinforced panel and having a rear surface attached the left and right structures, E) A back support section and a seat section, wherein the back support section is attached to the front surface of the central support structure and the seat section is attached to the first upper surface of the inner reinforced panel, F) A passage that is attached to and extends across the second upper surface of the inner reinforced panel and G) At least one set of stairs that extend downward from the passage.

The plurality of panels and structures are reinforced by a combination of horizontal struts and angled struts. Also, the upper surface of the passage can include a coating of non-slip material.

To further enhance the utility of the PMSA an optional indicia viewing structure can be, added. The viewing structure includes a set of vertical poles horizontally spaced and attached by means of bolts to the central support structure. The vertical poles have an upper end, and a lower end that abuts with the lower surface of the PMSA.

The indicia viewing structure includes a set of horizontally oriented rods that are swivally attached to the upper edge of the set of vertical poles. The rods each have an inner end and an outer end that have attached a first indicia viewing panel having an upper edge attached to the inner ends of the horizontal rods, and a second indicia viewing panel having an upper edge attached to the outer ends of the horizontal rods. The viewing panels can be adjustably angled by an adjustable mounting bracket that is attached between the vertical pole and the horizontal rod.

To also further enhance the utility of the PMSA, a water-resistant tarp can be attached across the area that encompasses the indicia viewing structure. The tarp is utilized during inclement weather or when there is bright sun light.

In view of the above disclosure, the primary object of the invention is to produce a PMSA that is relatively inexpensive, comfortable, safe and that can be easily assembled on a sport field or the like. In addition to the primary object of the invention it is also an object of the invention to provide a PMSA that:

- can be constructed of various materials,
- can be designed to include a selectable number of seats and stairs,
- can be painted in colors that pertain to the colors of a home team,
- can be easily disassembled into a relatively flat structure for transportation or storage,
- is durable and long-lasting,
- is maintenance free,
- only requires the use of basic, non-power tools for assembly and disassembly, and
- is cost effective from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
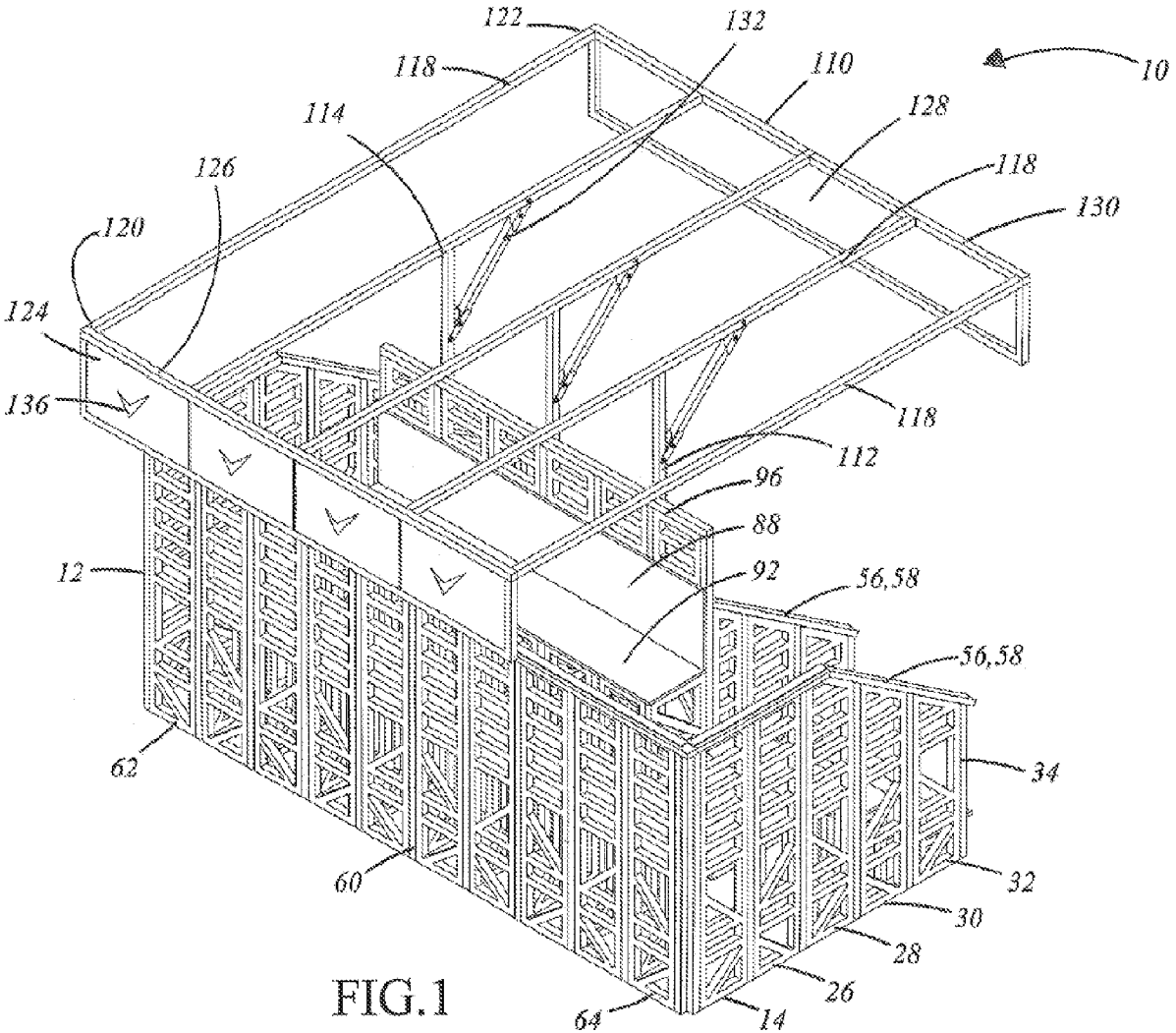
FIG. 1 is a front orthographic view of a portable modular seating assembly (PMSA) shown with an optional indicia viewing structure.

The best mode for carrying out the invention is presented in terms that disclose a preferred embodiment of a portable modular seating assembly (PMSA 10), which is designed to provide a relatively inexpensive, comfortable and safe means for viewing a sporting event that is played on a field or the like. The preferred embodiment, as shown in FIGS. 1-15, is comprised of the following major elements: a left structure 12, a right structure 34, a front structure 60, a left inner stair support structure 74, a right inner stair support structure 76, an inner reinforced panel 80, a passage 87, a back support section 88, a seat section 92, a central support structure 96, and an optional indicia viewing structure 110 having indicia 136.

The left structure 12 and the right structure 34 are mirror images of each other. Therefore, for brevity the constructive elements that comprise each structure 12,34 are described with reference to only the left structure 12.

Figure 2:
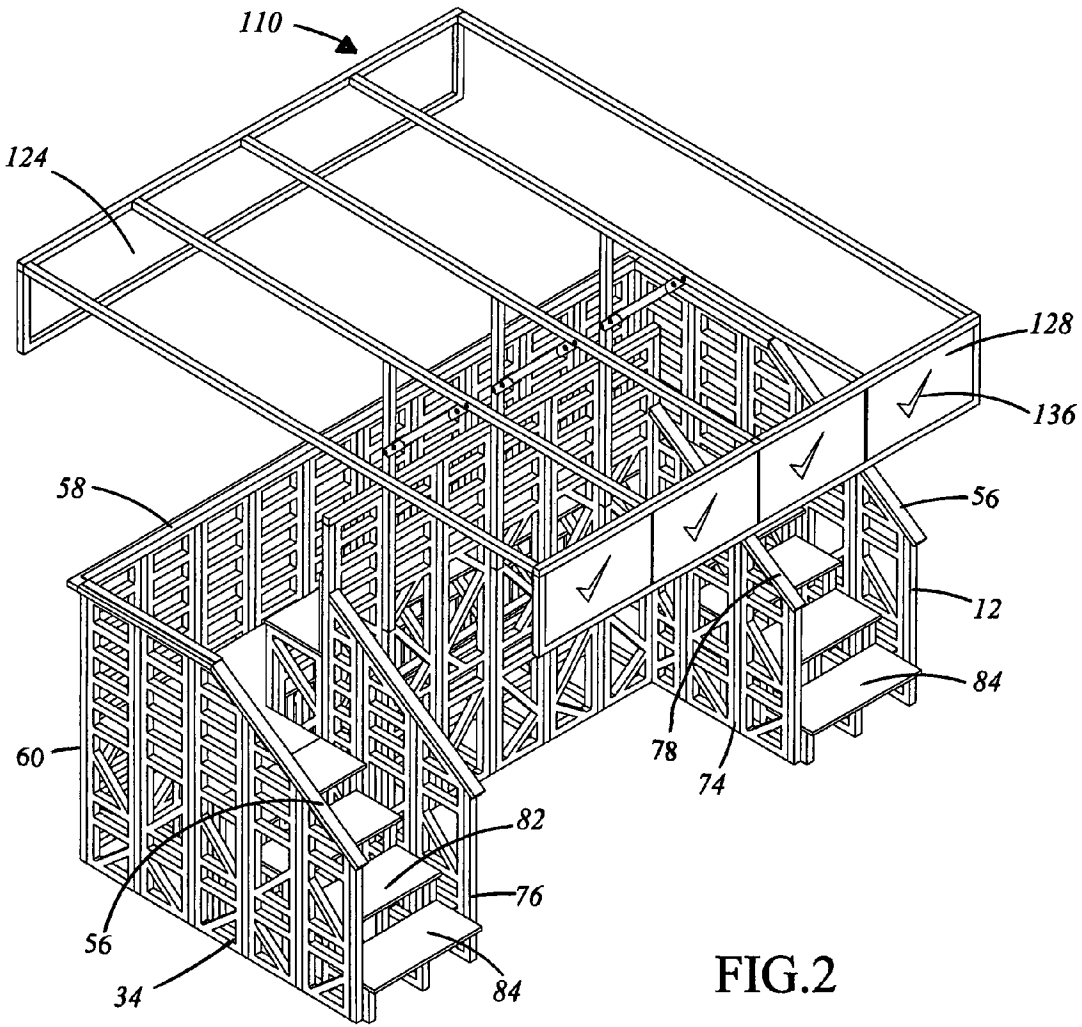
FIG. 2 is a rear orthographic view of the PMSA shown with the optional indicia viewing structure.
Figure 9:
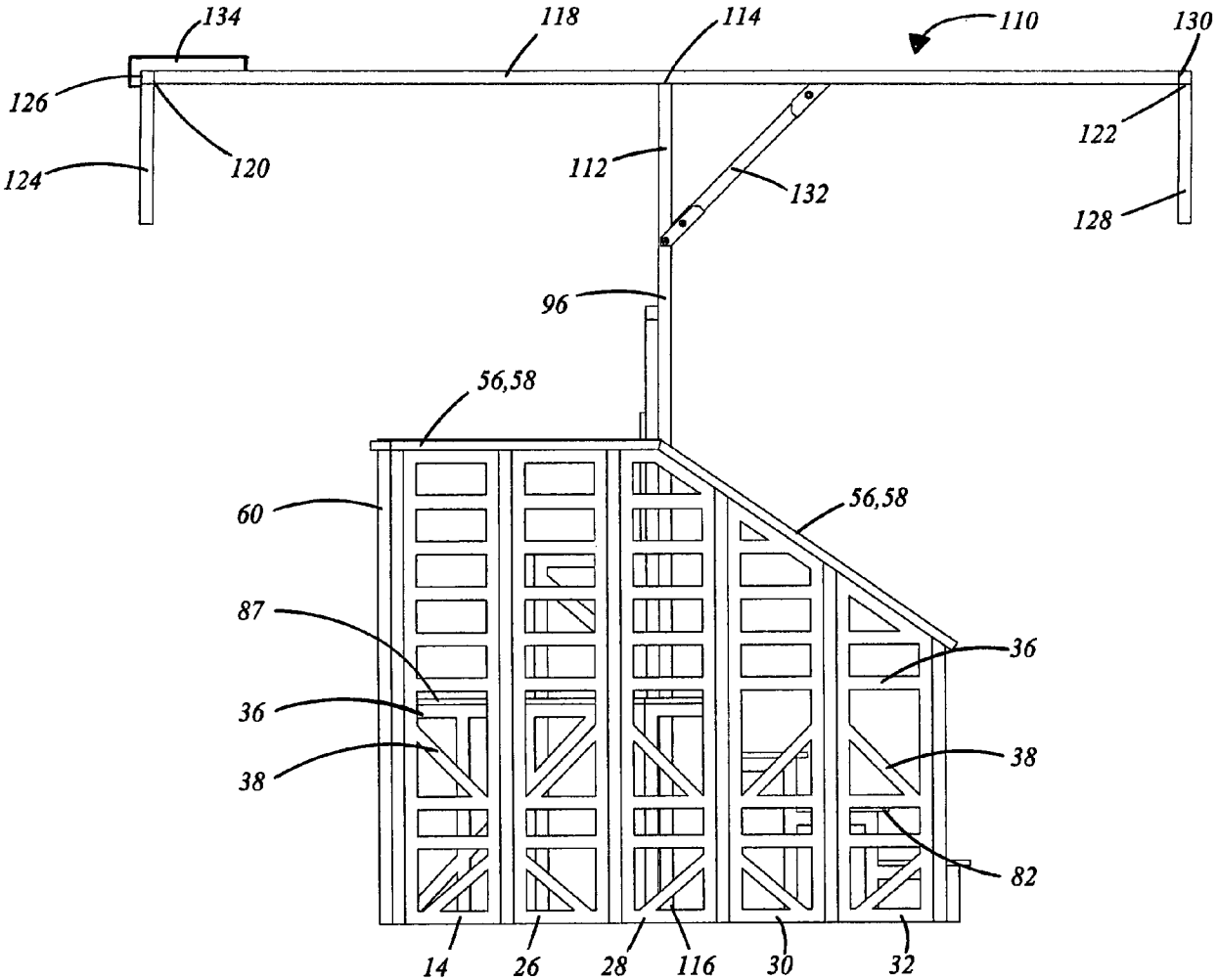
FIG. 9 is a elevational view of the PMSA shown with the indicia viewing structure attached.
Figure 10:
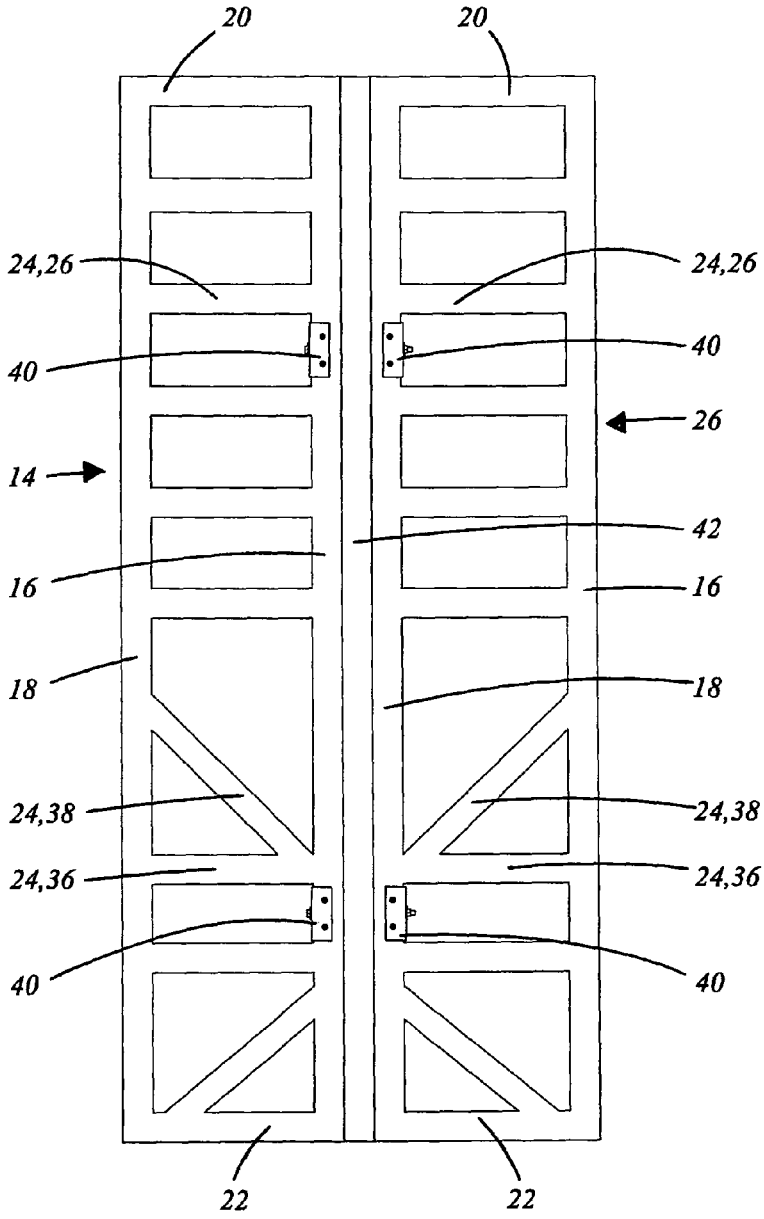
FIG. 10 is an elevational view of a first reinforced panel attached to a second reinforced panel by means of a first attachment means.

The left structure 12, as shown in FIGS. 1-6 and 8, is comprised of a first reinforced panel 14, a second reinforced panel 26, a third reinforced panel 28, a fourth reinforced panel 30, and a fifth reinforced panel 32. The number of reinforced panels is typically comprised of five panels, as shown in FIG. 9, however the number of reinforced panels on both the left and right structures 12,34 can range from four to six panels. All the panels are reinforced by a combination of horizontal struts 36 and angled struts 38, as best shown in FIG. 10. Also, as shown in FIG. 2, the upper surfaces of the left structure 12, the right structure 34, and the left and right inner stair support structures 74,76 can include a banister 58. Alternatively, the banister 58 can also be configured to encompass the entire upper edge of the PMSA 10, as also shown in FIG. 2.

The first reinforced panel 14, as shown in FIG. 9, has a rear vertical member 16, a front vertical member 18, an upper horizontal member 20, a lower horizontal member 22, and a plurality of panel reinforcing struts 24. The struts 24 are located within the boundaries of the rear and front vertical members 16,18 and between the upper and lower horizontal members 20,22.

Figure 12:
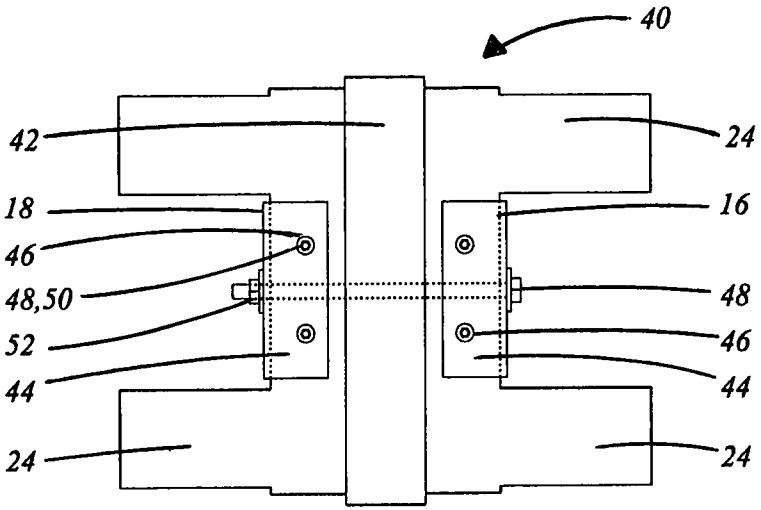
FIG. 12 is a partial elevational view of the first attachment means.

The second reinforced panel 26 has a front vertical member 18 that is attached to the rear vertical member 16 located on the first reinforced panel 14 by a first attachment means 40. The second reinforced panel 26 also has an upper horizontal member 20 that is in alignment with the upper horizontal member 20 on the first reinforced panel 14, a lower horizontal member 22 that is in alignment with the lower horizontal member 22 on the first reinforced panel 14, and a plurality of panel reinforcing struts 24 located within the boundaries of the rear and front vertical members 16,18 and between the upper and lower horizontal members 20,22. The first attachment means 40, as shown in FIGS. 10 and 12, is comprised of a rigid vertical rod 42 that is preferably made of a metal, and that is placed between an adjacent pair of vertical members 16,18. External to the vertical rod 42 is attached a pair of front and rear U-shaped brackets 44. The brackets 44 are attached to the respective vertical members 16,18 by a set of bolts 46 or screws, as shown best in FIG. 12. The two U-shaped brackets 44 are tightened by a central bolt 48. The central bolt 48 is sequentially inserted through a set of bores 50 located on the right U-shaped bracket 44, the rear vertical member 16, the rigid vertical rod 42, the left U-shaped bracket 44 and the front vertical member 18, where a nut 52 tightens the central bolt 48. The combination of the elements that comprise the first attachment means 40 enhances the structural integrity of the PMSA 10.

The third reinforced panel 28 has a front vertical member 18 that is attached by the first attachment means 40 to the rear vertical member 16 on the second reinforced panel 26, a rear vertical panel 16, an upper horizontal member 20 having a slope 56 that angles downward, a lower horizontal member 22 that is in alignment with the lower horizontal member 22 on the second panel 26, and a plurality of panel reinforcing struts 24 that are located within the boundaries of the rear and front vertical members 16,18 and between the upper and lower horizontal members 20,22, The fourth reinforced panel 30 has a front vertical member 18 that is attached by the first attachment means 40 to the rear vertical member 16 on the third reinforced panel 28, a rear vertical member 16, an upper horizontal member 20 having a slope 56 that continues downward in alignment with the slope 56 on the upper horizontal member 20 of the third reinforced panel 28, and a lower horizontal member 22 that is in alignment with the lower horizontal member 22 on the third reinforced panel 28.

The fifth reinforced panel 32, as also shown in FIG. 9, has a front vertical member. 18 that is attached by the first attachment means 40 to the rear vertical member 16 on the fourth reinforced panel 30, a rear vertical member 16, an upper horizontal member 20 having a slope 56 that continuous downward in alignment with the slope 56 on the upper horizontal member 20 of the fourth reinforced panel 30, and a lower horizontal member 22 that is in alignment with the horizontal member 22 on the fourth reinforced panel 30.

The right structure 34, as shown in FIGS. 1 and 2, is a mirror image of the left structure 12 and therefore is not described.

Figure 3:
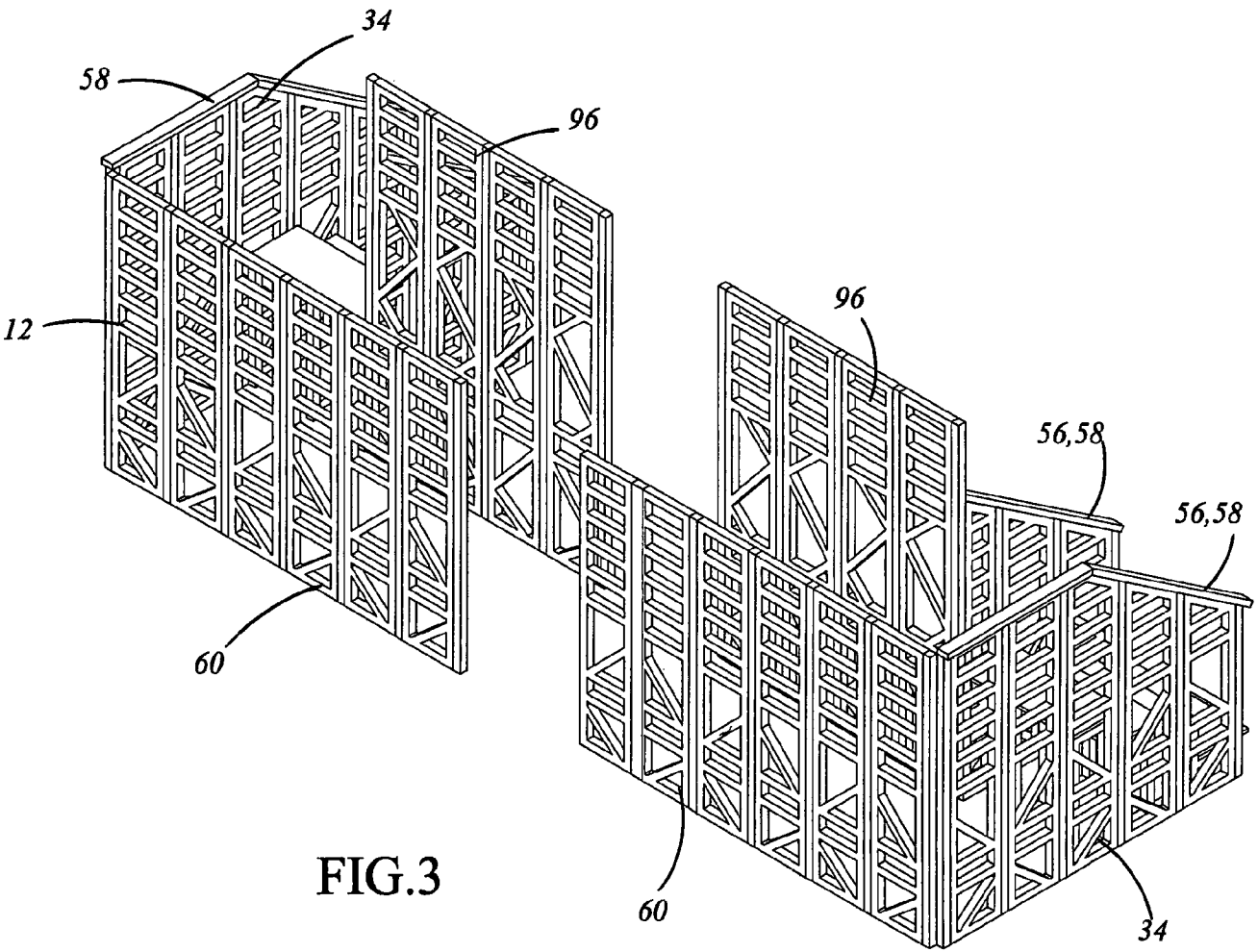
FIG. 3 is a front orthographic view of the PMSA shown with a right and left module prior to being attached.
Figure 4:
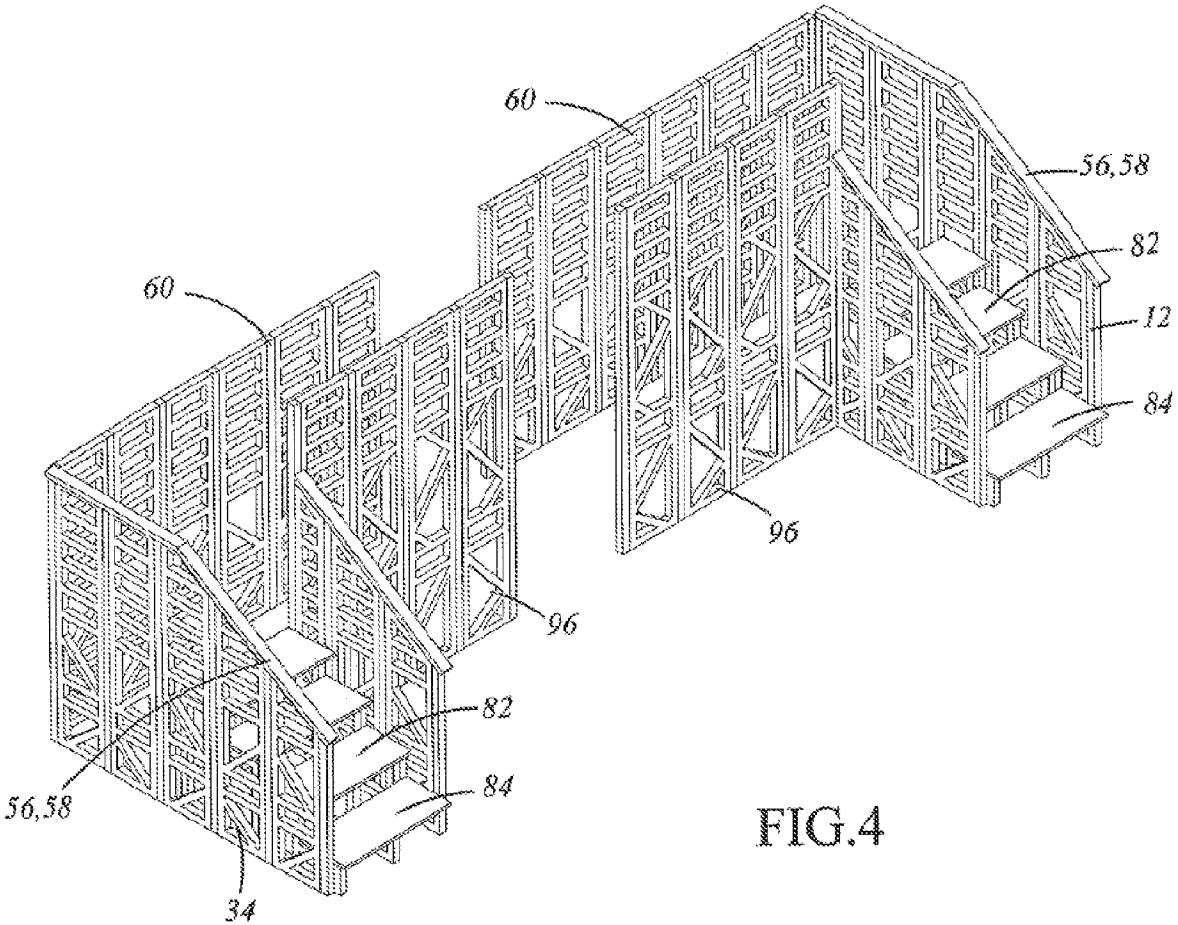
FIG. 4 is a rear orthographic view of the PMSA shown with a right and left stair module and a central section prior to being attached.
Figure 6:
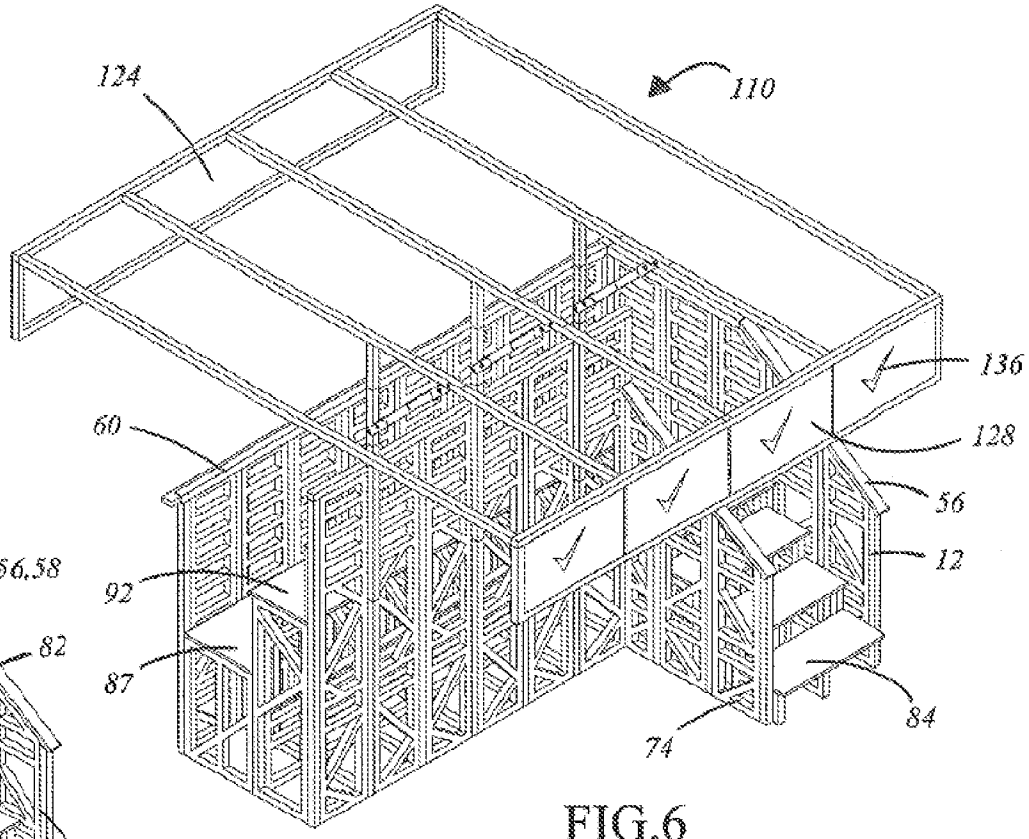
FIG. 6 is a rear orthographic view shown with a stair module attached to the central section and with an indicia viewing structure attached.
Figure 7:
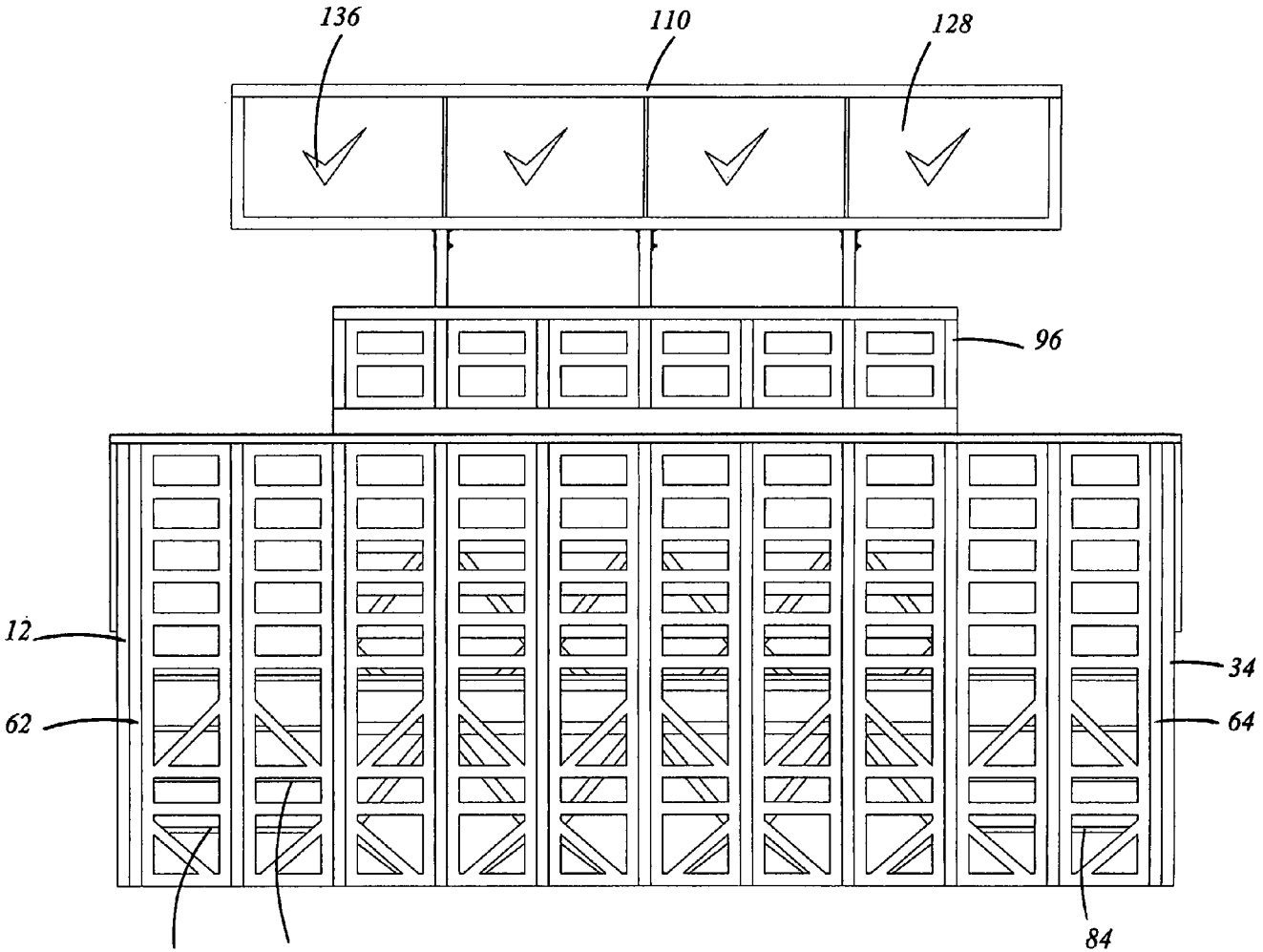
FIG. 7 is a front elevational view of the PMSA shown with the indicia viewing structure attached.
Figure 8:
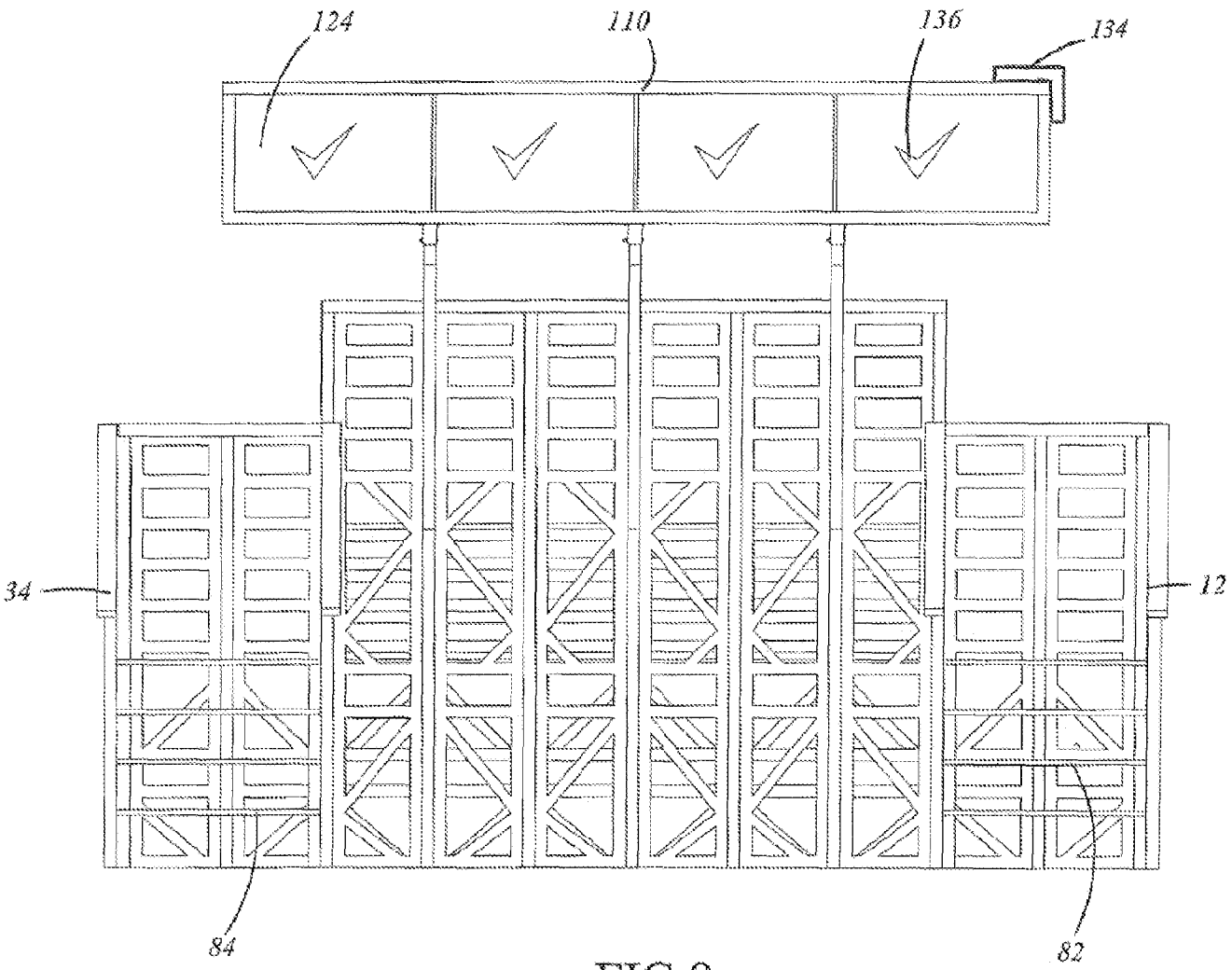
FIG. 8 is a rear elevational view of the PMSA shown with the indicia viewing structure attached.
Figure 13:
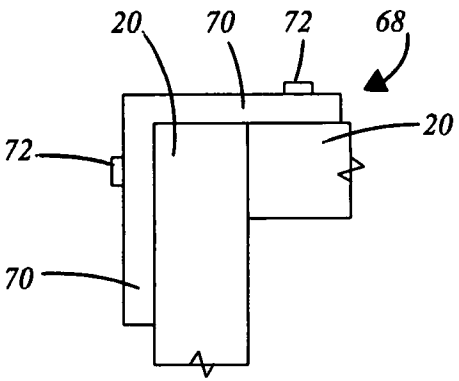
FIG. 13 is a partial plan view of a second attachment means.

The front structure 60, as shown in FIGS. 1, 2 and 3, is comprised of a plurality of reinforced panels that can range from eight to twelve panels. The plurality of reinforced panels form an assembled front structure 60 that terminates at a left reinforced panel 62 and a right reinforced panel 64, as shown in FIGS. 6 and 7. The left reinforced panel 62 is attached by a second attachment means 68 to the first reinforced panel 14 on the left structure 12, and the right reinforced panel 64 is attached by the second attachment means 68 to the first reinforced panel 14 located on the right structure 34. The second attachment means 68, as shown in FIG. 13, is comprised of a 90-degree corner bracket 70 that is attached by a screw 72 or a bolt 66.

Figure 5:
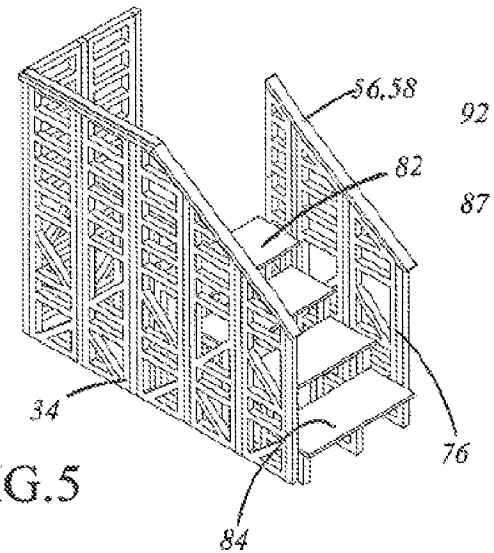
FIG. 5 is a rear orthographic view shown with a stair module prior to being attached.

The left inner stair support structure 74, as shown in FIG. 6, and the right inner stair support structure 76, as shown in FIG. 5, function in combination with an outer stair support structure that is comprised respectively of the left and right structures 12,34. Both the left and right inner support structures 74,76 have a plurality of reinforced panels each having an upper edge having a slope 78 that is in alignment with the slope 56 on the left and right structures 12,34. A plurality of stairs 82 are attached between the outer and inner stair support structures 74,76, as shown in FIG. 2, wherein the upper stair 82 has a terminating edge 86. The number of stairs 82 can range from four to six stairs with the lowest stair 84 elevated from the bottom surface of the PMSA 10.

Figure 14:
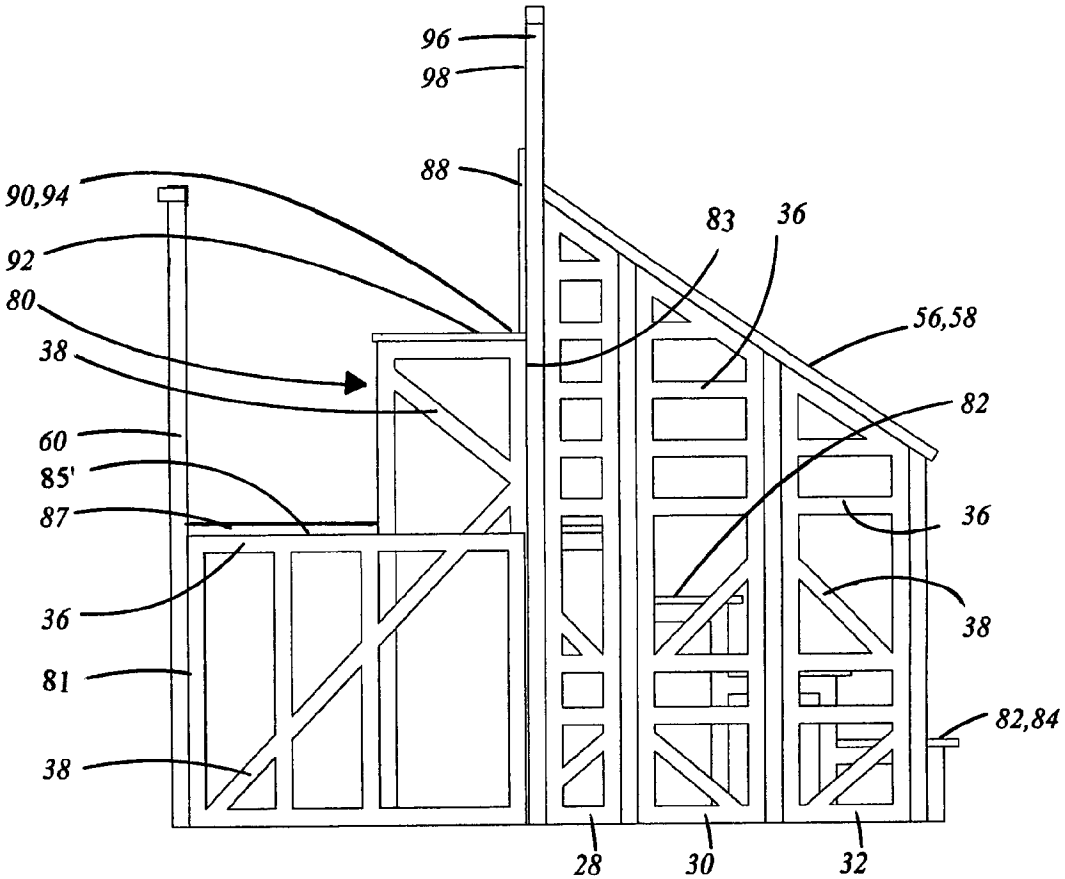
FIG. 14 is a side elevational view showing an interior support panel.

The inner reinforced panel 80, as best shown in FIGS. 6 and 14, has a front surface 81 that is attached to the front structure 60, a rear surface 83, a first upper surface 85 and a second upper surface 85'. Attached to the rear surface 83 is the front surface 98 of the central support structure 96, as best shown in FIG. 14.

Figure 11:
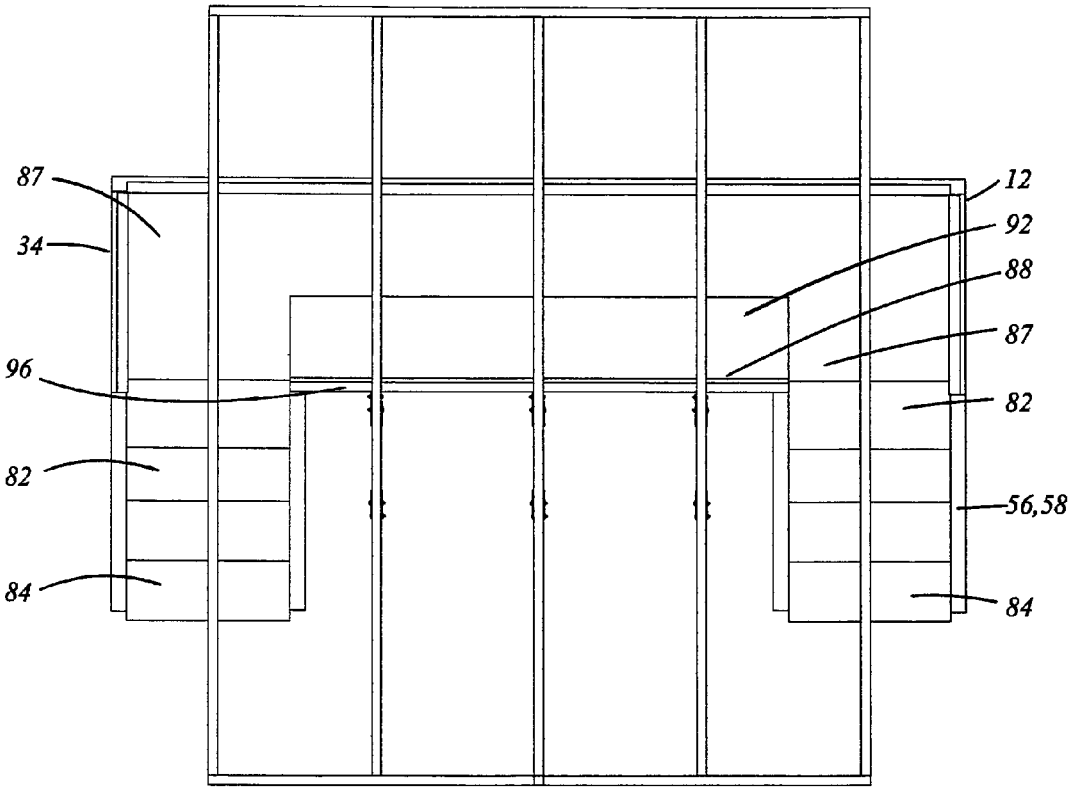
FIG. 11 is a top plan view of the PMSA.
Figure 15:
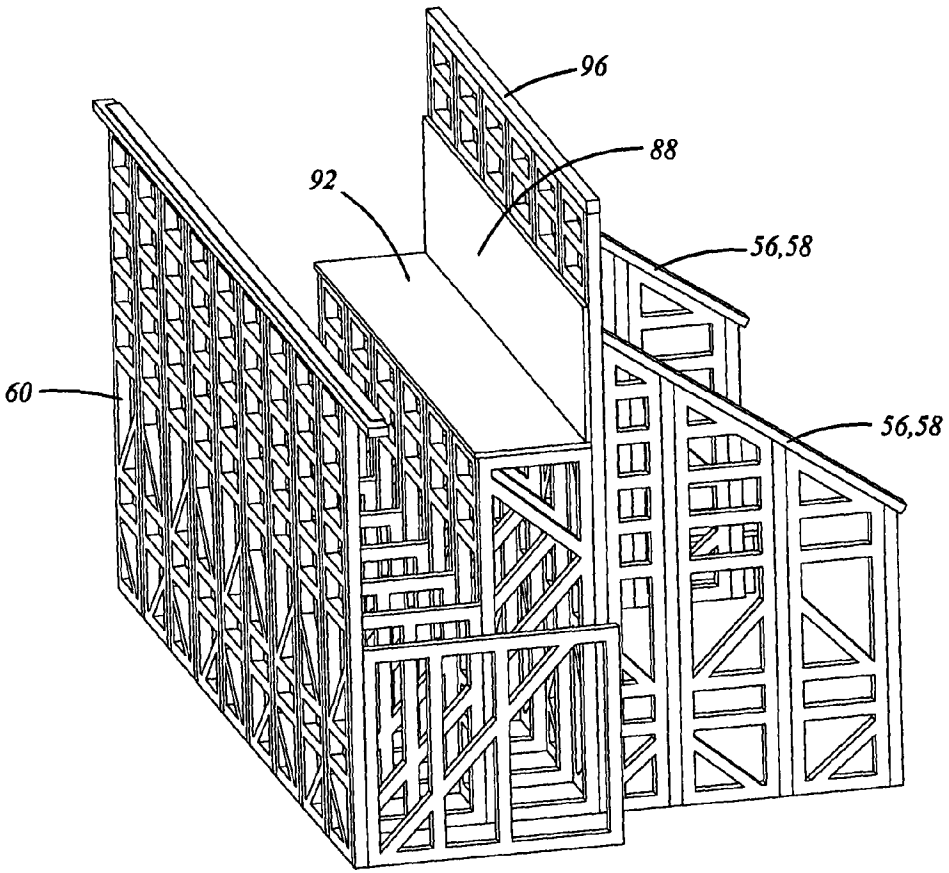
FIG. 15 is a side elevational view showing the interior support panels attached to the PMSA.

The back support section 88 and the seat support section 92, as shown in FIGS. 14 and 15, add further utility to the PMSA 10. The back support section 88 has a lower edge 90 that is attached to the front surface 88 of the central support structure 96. Likewise the seat support section 92 has an inner edge 94 that interfaces with the lower edge 90 of the back support section 88. As shown best in FIG. 14, the seat section 92 is secured to the first upper surface 85 of the inner reinforced panels 80. The seat section 92 can optimally be divided into individual seating sections (not shown). To allow a person to be seated or to leave the seat a passage 87 is provided, as best shown in FIG. 11. The passage 87 is attached by means of screws or bolts to the second upper surface 85' located on the inner reinforced panel 80.

The final element described is the optional indicia viewing structure 110, as shown in FIGS. 1, 7, 8 and 9, and is comprised of a set of vertical poles 112, a set of horizontally oriented rods 118, a first indicia viewing panel 124, a second indicia viewing panel 128 and an adjustable angled member 132.

The set of vertical poles 112 are horizontally spaced and attached by means of bolts to the front surface of the central support structure 96. The vertical poles 112 have an upper end 114, and a lower end 116 that abut with the lower surface of the PMSA 10. The set of horizontally oriented rods 118 are swivally attached to the upper edges of the set of vertical poles 112. The rods 118 each have an inner end 120 and an outer end 122.

The first indicia viewing panel 124 has an upper edge 126 that is attached to the inner ends 120 of the horizontally oriented rods 118. The second indicia viewing panel 128 has an upper edge 130 that is attached to the outer ends 122 of the horizontal rods 118. To enhance the utility of the PMSA 10, the indicia viewing panels 124,128 can be divided into a set of separate viewing panels. Preferably, the indicia display is comprised of a static display. Additionally, as shown in FIG. 9, a water-resistant tarp 134 dimensioned to be secured by an attachment means across an area that encompasses the indicia viewing structure 110.

While the invention has been described in detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

The invention claimed is:

1. A portable modular seating assembly comprising:

a) a left structure and a right structure each having a front edge and a rear edge, b) a front structure having a front surface and a rear surface, c) an inner reinforced panel having a front surface attached to the rear surface of said front structure, a rear surface, a first upper surface and a second upper surface, d) a central support structure having a front surface attached to the rear surface on said inner reinforced panel and having a rear surface attached said left and right structures, e) a back support section and a seat section, wherein said back support section is attached to the front surface of said central support structure and said seat section is attached to the first upper surface of said inner reinforced panel, f) a passage that is attached to and extends across the second upper surface of said inner reinforced panel, and g) at least one set of stairs that extend downward from said passage.

2. The PMSA as specified in claim 1 wherein said plurality of said left and right structures are reinforced by a combination of horizontal struts and angled struts.

3. The PMSA as specified in claim 2 wherein the upper surface of said passage further comprises a non-slip surface.

4. The PMSA as specified in claim 1 further comprising an indicia viewing structure having:

a) a set of vertical poles horizontally spaced and attached by means of bolts to the front surface of said central structure, wherein the vertical poles have an upper end and a lower end that abuts with the lower surface of said PMSA, b) a set of horizontally oriented rods that are swivally attached to the upper edge of the set of vertical poles, wherein the rods each have an inner end and an outer end, c) a first indicia viewing panel having an upper edge that is attached to the inner ends of the horizontal rods, d) a second indicia viewing panel having an upper edge that is attached to the outer ends of the horizontal rods, and e) an adjustable angle mounting bracket that is attached between the vertical pole and the horizontal rod.

5. The PMSA as specified in claim 4 wherein said indicia viewing structure is divided into a set of panels, wherein to each panel is attached a static viewing plate.

6. The PMSA as specified in claim 1 further comprising a water-resistant tarp that is designed and dimensioned to be attached by an attachment means across the upper area that encompasses said indicia viewing structure.

7. A portable modular seating assembly (PMSA) comprising:

a) a left structure comprising:

(1) a first reinforced panel having a front vertical member, a rear vertical member, an upper horizontal member, a lower horizontal member, and a plurality of panel reinforcing struts located within the boundaries of the front and rear vertical members and between the upper and lower horizontal members, (2) a second reinforced panel having a front vertical member attached by a first attachment means to the rear vertical member on said first reinforced panel, a rear vertical member, an upper horizontal member that is in alignment with the upper horizontal member on said first reinforced panel, a lower horizontal member that is in alignment with the lower horizontal member on said first reinforced panel, and a plurality of panel reinforcing struts located within the boundaries of the front and rear vertical members and between the upper and lower horizontal members, (3) a third reinforced panel having a front vertical member attached by the first attachment means to the rear vertical member on said second reinforced panel, a rear vertical panel, an upper horizontal member having a slope that angles downward, a lower horizontal member that is in alignment with the lower horizontal member on said second panel, and a plurality of panel reinforcing struts located within the boundaries of the rear and front vertical members and between the upper and lower horizontal members, (4) a fourth reinforced panel having a front vertical member attached by the first attachment means to the rear vertical member on said third reinforced panel, a rear vertical member, an upper horizontal member having a slope that continues downward in alignment with the slope on the upper horizontal member of said third reinforced panel, and a lower horizontal member that is in alignment with the horizontal member on said third reinforced panel, (5) a fifth reinforced panel having a front vertical member attached by the first attachment means to the rear vertical member on said fourth reinforced panel, a rear vertical member, an upper horizontal member having a slope that continuous downward in alignment with the slope on the upper horizontal member of said fourth reinforced panel, and a lower horizontal member that is in alignment with the horizontal member on said fourth reinforced panel, b) a right structure that is a mirror image of said left structure, c) a front structure comprising a plurality of reinforced panels attached by the first attachment means to the respective front vertical members to form an assembled front structure that terminates at a left reinforced panel and a right reinforced panel, wherein said left reinforced panel is attached by a second attachment means to said first reinforced panel on said left structure, and said right reinforced panel is attached by the second attachment means to said first reinforced panel on said right structure, d) a left inner stair support structure that functions in combination with an outer stair support structure that is comprised of said left structure, wherein a plurality of stairs are attached between the two structures, e) a right inner stair support structure that is a mirror image of said left inner stair support structure, f) an inner reinforced panel having a front surface that is attached to the front structure, a rear surface, a first upper surface and a second upper surface, g) a central support structure having a front surface that is attached to the rear surface of said inner reinforced panel and a rear surface that is attached to the third reinforced panel, h) a back support section having a lower edge and that is attached to the front surface of said central support structure, i) a seat section having an inner edge that interfaces with the lower edge of the back support section and that is attached to the first upper surface on said inner reinforced panels, and j) a passage that is attached to the second upper surface of said inner reinforced panel and that extends across the second upper surface on said inner reinforced panel.

8. The PMSA as specified in claim 7 wherein said reinforcing struts on said reinforced panels are comprised of a combination of horizontal struts and angled struts.

9. The PMSA as specified in claim 7 wherein said seat section is divided into individual seating sections.

10. The PMSA as specified in claim 7 further comprising a banister that is attached to the upper surface of said left structure, said right structure, and to the upper surface of said front structure.

11. The PMSA as specified in claim 10 wherein said banister is configured to encompass the entire upper edge of said PMSA.

12. The PMSA as specified in claim 7 wherein the number of reinforced panels on said left and right structure range from 4 to 6 panels.

13. The PMSA as specified in claim 7 wherein the number of reinforced panels on said front structure can range from 8 to 12 panels.

14. The PMSA as specified in claim 7 wherein the number of stairs can range from 4 to 6 stairs, wherein the lowest stair is elevated from the bottom surface of the PMSA.

15. The PMSA as specified in claim 7 further comprising an indicia viewing structure having:

a) a set of vertical poles horizontally spaced and attached by means of bolts to the front surface of said central support structure, wherein the vertical poles have an upper end, and a lower end that abuts with the lower surface of said PMSA, b) a set of horizontally oriented rods that are swivally attached to the upper edges of the set of vertical poles, wherein the rods each have an inner end and an outer end, c) a first indicia viewing panel having an upper edge that is attached to the inner ends of the horizontal rods, d) a second indicia viewing panel having an upper edge that is attached to the outer ends of the horizontal ends, and e) an adjustable angled member that is attached from the vertical poles to the horizontal rods.

16. The PMSA as specified in claim 15 wherein said indicia viewing panel can be divided into multiple, separate viewing panels.

17. The PMSA as specified in claim 7 further comprising a water-resistant tarp that is dimensioned to be attached by an attachment means across an area that encompasses said indicia viewing structure.

18. The PMSA as specified in claim 16 wherein said indicia display is comprised of a static display.

19. The PMSA as specified in claim 7 wherein the first attachment means comprises:

a) a rigid vertical rod that is placed between an adjacent pair of vertical members, and b) a pair of front and rear U-shaped brackets that fit over and that are attached to the respective vertical members by a set of bolts, wherein the pair of U-shaped brackets are tightened by a central bolt that is sequentially inserted into a bore on the vertical members, a bore through the rigid vertical rod and through a bore on the front vertical member.

20. The PMSA as specified in claim 7 wherein the second attachment means comprises an L-shaped bracket that encompasses and abuts with the two interfacing reinforced panels, wherein the L-shaped bracket is attached by means of bolts or screws.

* * * * *